US012433364B2

(12) United States Patent
Marotte

(10) Patent No.: US 12,433,364 B2
(45) Date of Patent: Oct. 7, 2025

(54) HARD HAT HAVING AN ARTICULATED CHEEK PLATE

(71) Applicant: TECHNOWILL, Tavaux (FR)

(72) Inventor: Philippe Marotte, Quingey (FR)

(73) Assignee: TECHNOWILL, Tavaux (FR)

( * ) Notice: Subject to any disclaimer, the term of this patent is extended or adjusted under 35 U.S.C. 154(b) by 0 days.

(21) Appl. No.: 18/259,046

(22) PCT Filed: Dec. 23, 2021

(86) PCT No.: PCT/FR2021/052439

§ 371 (c)(1),
(2) Date: Oct. 12, 2023

(87) PCT Pub. No.: WO2022/136806

PCT Pub. Date: Jun. 3, 2022

(65) Prior Publication Data

US 2024/0298734 A1 Sep. 12, 2024

(30) Foreign Application Priority Data

Dec. 23, 2020 (FR) ..... 2014081

(51) Int. Cl.
*A42B 3/20* (2006.01)

(52) U.S. Cl.
CPC ..... *A42B 3/205* (2013.01)

(58) Field of Classification Search
CPC ..... A42B 3/205; A42B 3/18; A42B 3/222; A42B 3/223; A42B 3/326; A42B 3/225
See application file for complete search history.

(56) References Cited

U.S. PATENT DOCUMENTS 4,689,836 A * 9/1987 Vitaloni ..... A42B 3/222 2/9
4,769,857 A * 9/1988 Cianfanelli ..... A42B 3/326 2/424
6,125,477 A * 10/2000 Crippa ..... A42B 3/326 2/10
6,249,918 B1 * 6/2001 Lacroix ..... A42B 3/226 2/424
6,298,498 B1 10/2001 Burns
(Continued)

FOREIGN PATENT DOCUMENTS

WO 2005115188 A1 12/2005
WO WO-2013110675 A1 * 8/2013 ..... A42B 3/222

OTHER PUBLICATIONS

French Search Report received for FR Application No. FR2014081 on Sep. 10, 2021, 8 pgs.
(Continued)

*Primary Examiner* — Alissa L Hoey
(74) *Attorney, Agent, or Firm* — Merchant & Gould P.C.

(57) ABSTRACT

A hard hat worn by an individual includes a crown and a visor to protect a region of a face of the individual. A cheek plate is movable between a retracted position and a protective position in which the cheek plate is arranged at least partially around the visor. An articulation system articulates the cheek plate with respect to the crown. The articulation system guides movement of the cheek plate, and includes a clamp to clamp the cheek plate against the visor when the cheek plate is close to or in the protective position.

7 Claims, 10 Drawing Sheets

(56) References Cited

U.S. PATENT DOCUMENTS

| | | | | |
|---|---|---|---|---|
| 6,598,238 | B2 * | 7/2003 | Hong | A42B 3/326 2/424 |
| 6,931,670 | B2 * | 8/2005 | Arai | A42B 3/222 2/424 |
| 8,056,152 | B2 * | 11/2011 | Brace | A42B 3/225 2/424 |
| 8,082,600 | B2 * | 12/2011 | Morin | A42B 3/326 2/424 |
| 8,495,763 | B2 * | 7/2013 | Gafforio | A42B 3/326 2/6.2 |
| 9,060,557 | B2 * | 6/2015 | Maier | A42B 3/04 |
| 9,848,667 | B2 * | 12/2017 | Brace | A42B 3/225 |
| 9,854,866 | B2 * | 1/2018 | Berthier | A42B 3/222 |
| 10,136,693 | B1 | 11/2018 | Paulson | |
| 10,143,259 | B2 * | 12/2018 | Liao | A42B 3/326 |
| 10,212,982 | B2 * | 2/2019 | Nimura | A42B 3/22 |
| 10,492,559 | B1 * | 12/2019 | Kele | A42B 3/326 |
| 11,064,755 | B1 * | 7/2021 | Williams | A42B 3/223 |
| 11,241,061 | B2 * | 2/2022 | Liao | A42B 3/223 |
| 11,278,078 | B2 * | 3/2022 | Fiorino | A42B 3/222 |
| 11,330,858 | B2 * | 5/2022 | Nimura | A42B 3/326 |
| 11,412,807 | B2 * | 8/2022 | Jwa | A42B 3/205 |
| 11,696,613 | B2 * | 7/2023 | Liao | A42B 3/205 2/424 |
| 11,805,839 | B2 * | 11/2023 | Lu | A42B 3/222 |
| 11,903,438 | B2 * | 2/2024 | Guazzerotti | A42B 3/222 |
| 11,944,148 | B2 * | 4/2024 | Becker | A42B 3/326 |
| 12,016,419 | B2 * | 6/2024 | Paulson | A42B 3/225 |
| 2008/0028501 | A1 * | 2/2008 | Schimpf | A42B 3/226 2/424 |
| 2008/0196148 | A1 * | 8/2008 | Morin | A42B 3/222 2/10 |
| 2009/0100576 | A1 * | 4/2009 | Kim | A42B 3/326 2/9 |
| 2012/0284906 | A1 * | 11/2012 | Kuo | A42B 3/223 2/424 |
| 2016/0015114 | A1 * | 1/2016 | Berthier | A42B 3/222 2/424 |
| 2020/0178639 | A1 * | 6/2020 | Jwa | A42B 3/205 |
| 2024/0065364 | A1 * | 2/2024 | Lee | A42B 3/205 |
| 2024/0081463 | A1 * | 3/2024 | Lee | A42B 3/222 |
| 2024/0180282 | A1 * | 6/2024 | Lee | A42B 3/223 |
| 2024/0285019 | A1 * | 8/2024 | Reitebuch | A61F 9/029 |

OTHER PUBLICATIONS

International Search Report and Written Opinion received for PCT Serial No. PCT/FR2021/052439 on May 16, 2022, 11 pgs.

* cited by examiner

HARD HAT HAVING AN ARTICULATED CHEEK PLATE

CROSS-REFERENCE TO RELATED APPLICATION

This application is a National Phase Entry of PCT Serial No.: PCT/FR2021/052439, filed Dec. 23, 2021, which claims benefit of Patent Application No. FR2014081, filed Dec. 23, 2020 in France, the disclosures of which are incorporated herein by reference in their entirety.

FIELD OF THE INVENTION

The present invention relates to a safety helmet, or protective helmet, of the PPE (personal protective equipment) type comprising a chin guard articulated according to a chin guard kinematics.

PRIOR ART

Safety helmets are used, for example, by electricians. Safety helmets must protect their wearer against shocks or external physical attacks, in a similar way to construction helmets. In addition, safety helmets must provide protection against short-circuits. Such short-circuits can generate a more or less significant electric arc, manifested for example by sudden and intense light, projections of molten particles, blast effect, etc.

A safety helmet conventionally comprises a shell protecting the skull of the wearer and a shield protecting part of the face of the wearer.

The shield can be mounted on the shell so as to be movable between a raised position in which the shield is retracted to expose the face of the wearer of the helmet and a lowered position in which the shield is disposed oppositely to the face of the wearer. Thus, a user wearing the helmet can choose to protect their face or retract the shield when desired.

The shapes of the shield and of the shell are generally different. Indeed, the shape of the shield is in particular constrained by optical quality requirements, while the shape of the shell is in particular constrained by mechanical (for example shock resistance), normative, and aesthetic (concerning the outer shape of the helmet) considerations.

In a first type of safety helmet, the shield is mounted in a more outer position than the shell of the helmet, and is movable between the raised position and the lowered position by means of a sliding movement of the shield on the shell of the helmet or by an articulation movement. This first type of helmet is not constrained in terms of shapes of the shield and of the shell, but the shield is exposed to scratches and other external attacks, and the space requirement of the helmet is significant.

In a second type of safety helmet, the shield in the raised position is located between the shell and the head of the wearer of the helmet, the shield being obscured inside the helmet, in a more inner position than the shell. This second type of helmet makes it possible to protect the shield from scratches and other external attacks when the helmet is not worn, its lifespan then being increased. The space requirement of this second type of helmet is also reduced. On the other hand, obscuring the shield inside the helmet leads to shape constraints, in particular shield and shell shape constraints. The shape constraints of the helmet shell are related to the shape constraints of the shield, and the shape constraints of the shield are closely related to the desired optical quality requirements.

This second type of helmet, on the other hand, requires an adaptation of the shapes of the shield and of the shell, as well as of the kinematics of displacement of the shield, in view of the potentially different shapes of the shield and of the shell, in order to allow the shield to be obscured inside the helmet.

The shield does not protect the entire face of the wearer, particularly the sides of the face and the chin of the wearer of the helmet. Indeed, the dimensions of the shield are limited, in particular in the second type of helmet due to its retraction inside the helmet. Consequently, the shield alone does not provide a satisfactory level of protection, particularly when it comes to protecting the wearer against short-circuits.

Some current safety helmets propose additional protective elements intended to provide protection for the sides of the face and/or the chin of the face of the wearer of the helmet, particularly protection against short-circuits.

For example, an additional protective element made of fabric, such as a hood, can be worn under the helmet, or fixed to a movable element such as the shield of the helmet. The hood protects the chin and the sides of the face of the wearer. However, the use of fabric has disadvantages because the fabric gets very dirty, is difficult to clean and can contain many microbes and bacteria.

Some current helmets propose to fix an additional protective element to the shield, under the shield, in particular to protect an area of the chin of the wearer of the helmet. The assembly formed by the additional protective element and the shield can then be raised or lowered by the wearer of the helmet. Nevertheless, the weight of the assembly to be moved by the wearer of the helmet between the raised position and the lowered position is then substantial. Furthermore, in the event of a short-circuit, the blast may possibly rush into the space between the shield and the helmet. Consequently, the protection ensured by these helmets is not optimal.

SUMMARY OF THE INVENTION

One aim of the invention is to propose a safety helmet comprising a chin guard articulated between a withdrawal position and a protection position.

Another aim of the invention is to propose a safety helmet making it possible to improve the protection of the face of the wearer of the helmet, particularly against short-circuits. According to a first aspect, the invention relates to a safety helmet adapted to be worn by an individual, comprising:

- a shell configured to receive a skull of the individual;
- a shield adapted to protect an area of the face of the individual;
- a chin guard adapted to be moved between a withdrawal position and a protection position, in which in the protection position, the chin guard is at least partially disposed around the shield so as to extend the area of protection of the face of the individual by the helmet;
- a system for articulating the chin guard relative to the shell, comprising means for guiding a displacement of the chin guard between the withdrawal position and the protection position, the safety helmet being characterized in that the articulation system further comprises means for pressing the chin guard against the shield which are adapted to press the chin guard against the shield when the chin guard is near or in the protection position.

Some preferred but non-limiting features of the safety helmet described above are as follows, taken individually or in combination:

- the pressing means of the articulation system comprise elastic pressing means adapted to exert a restoring force tending to press the chin guard against the shield and/or means for clipping the chin guard against the shield;
- the pressing means of the articulation system comprise a spring adapted to exert on the chin guard a restoring force tending to press the chin guard against the shield when the chin guard is near or in the protection position;
- the guide means of the articulation system comprise a guide slot and the chin guard comprises a guide pin adapted to slide inside the guide slot so as to guide a controlled displacement of the chin guard between the withdrawal and protection positions;
- the guide slot comprises:
- a first portion adapted to guide a sliding of the chin guard between the withdrawal position and a first intermediate position,
- a second portion adapted to guide a switching of the chin guard between the first intermediate position and a second intermediate position, in which in the second intermediate position, the chin guard is at least partially positioned around the shield and at a distance from the shield, and
- a third portion adapted to guide a pressing of the chin guard against the shield between the second intermediate position and the protection position;
- the guide slot has substantially the shape of a cane, the first portion and the third portion of the guide slot being disposed at a distance from each other and extending mainly in a longitudinal direction of the helmet, and the second portion of the guide slot being curved and connecting the first portion and the third portion of the guide slot;
- the articulation system comprises an additional guide slot having dimensions substantially similar to the dimensions of the first portion of the guide slot, the additional guide slot extending mainly in a longitudinal direction of the helmet and being disposed substantially in an extension of the third portion of the guide slot at a distance from the third portion of the guide slot, and the chin guard comprises an additional guide pin adapted to slide inside the additional guide slot when the chin guard is moved between the withdrawal and protection positions;
- the first portion of the guide slot comprises a rear end adapted to form an abutment for the guide pin when the chin guard is in the withdrawal position, and the third portion of the guide slot comprises a rear end adapted to form an abutment for the guide pin when the chin guard is in the protection position; and the additional guide slot comprises a rear end adapted to form an abutment for the additional guide pin when the chin guard is in the withdrawal position, and a front end adapted to form an abutment for the additional guide pin during the switching of the chin guard between the first intermediate position and the second intermediate position, the switching of the chin guard taking place around the additional guide pin;
- the guide means of the articulation system further comprise a connecting rod adapted to be added and fixed onto the guide pin and onto the additional guide pin.
- the connecting rod is adapted to bias the pressing means during a displacement of the chin guard between the first intermediate position and the second intermediate position;
- the shield is adapted to be moved between a lowered position in which the shield protects part of the face of the individual wearing the helmet, and a raised position in which the shield is obscured so as to expose the face of the individual wearing the helmet;

the system for articulating the chin guard relative to the shell is adapted to allow a controlled displacement of the chin guard between the protection position and the withdrawal position independently of a displacement of the shield between the lowered position and the raised position.

BRIEF DESCRIPTION OF THE FIGURES

Other features, aims and advantages of the present invention will appear upon reading the following detailed description, given by way of non-limiting example, which will be illustrated by the following figures.

DETAILED DESCRIPTION OF THE INVENTION

Figure 1A:
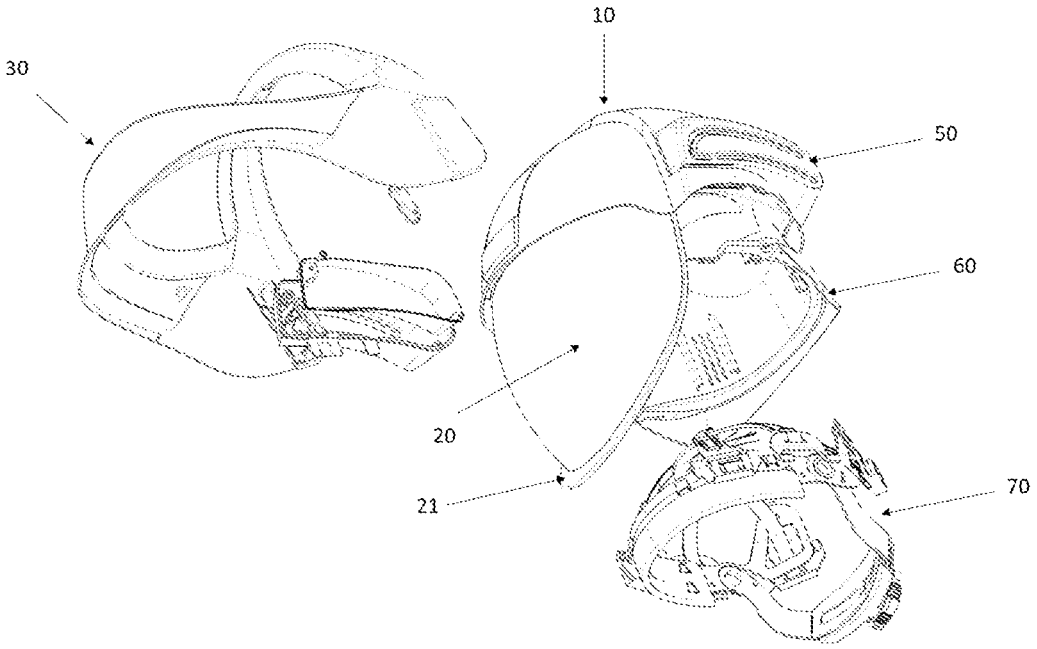
FIGS. 1*a* and 1*b* represent schematic exploded, respectively perspective and side, views of a safety helmet according to one embodiment of the invention.
Figure 1B:
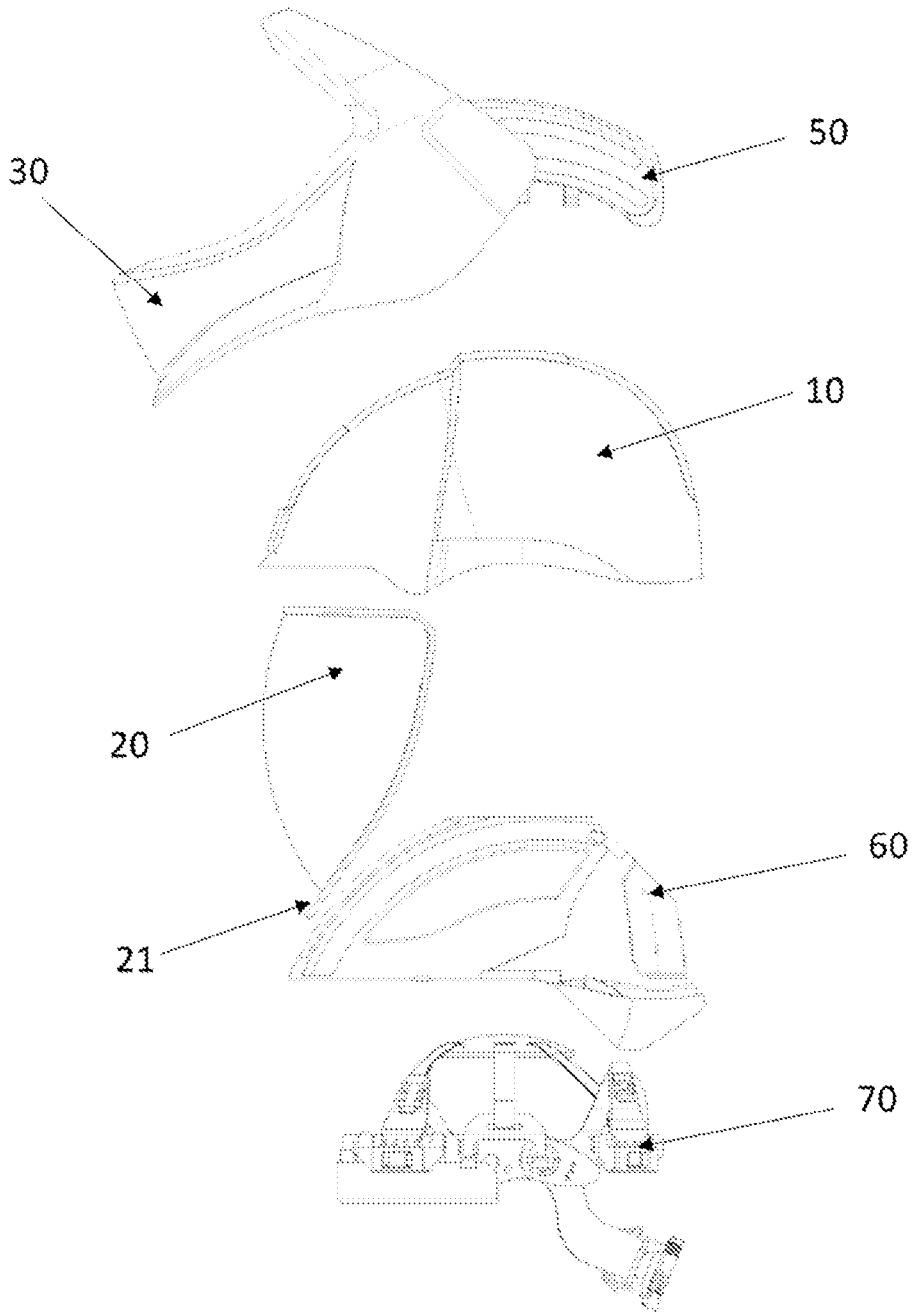

A safety helmet is illustrated by way of non-limiting example in FIGS. 1*a*, 1*b*, and 2 to 8.

The safety helmet comprises:

- a shell 10 configured to receive a skull of the individual;
- a shield 20 adapted to protect an area of a face of the individual;
- a chin guard 30 adapted to be moved between a withdrawal position and a protection position, in which, in the protection position, the chin guard 30 is disposed at least partially around the shield 20 so as to extend the protection area of the face of the individual through the helmet;

a system for articulating 50 the chin guard 30 relative to the shell 10, comprising means for guiding a displacement of the chin guard 30 between the withdrawal position and the protection position.

The articulation system 50 ensures the alignment of the chin guard 30 on the shield 20. The articulation system 50 further comprises means 90 for pressing the chin guard 30 against the shield 20 which are adapted to press the chin guard 30 against the shield 20 when the chin guard 30 is near or in the protection position.

The chin guard 30 is articulated relative to the shell 10 by means of the articulation system 50. The presence of the chin guard 30 movable between a withdrawal position and a protection position makes it possible, when the chin guard 30 is in the protection position, to enlarge the extent of the protection area of the face of the wearer of the helmet. In the protection position, the chin guard 30 disposed around the shield 20 provides peripheral protection to the protection offered by the shield 20. The chin guard 30 can in particular laterally extend around the shield 20 so as to cover the sides of the face, and/or an area of the chin of the wearer of the helmet. The chin guard 30 thus raises the level of protection by enlarging the face area protected by the helmet, and allows more effective facial and lateral protection, in particular against short-circuits.

The pressing of the chin guard 30 against the shield 20 in the protection position makes it possible to ensure continuity of the protection of the face of the wearer of the helmet provided by the chin guard 30 and the shield 20. Thus, there is no unprotected area between the area protected by the shield 20 and the area protected by the chin guard 30.

The shell 10, the shield 20 and the chin guard 30 can be disposed so as to continuously cover a space near the head of the wearer. Thus, a continuity of the protection is ensured between the shell 10 protecting the skull, the shield 20 protecting an area of the face, and the chin guard 30 providing protection of the face which is peripheral to the protection offered by the shield 20.

The pressing of the chin guard 30 against the shield 20 also ensures the correct positioning of the chin guard 30 against and around the shield 20 in the protection position. In addition, the pressing of the chin guard 30 against the shield 20 secures the positioning of the chin guard 30 in the protection position by limiting the risk of displacement of the chin guard 30 when it is in the protection position. Thus, the protection offered by the helmet is improved.

A space can be formed between the chin guard 30 and the shell 10 during the displacement of the chin guard 30 between the withdrawal position and the protection position, when the chin guard 30 is not pressed against the shield 20. Thus, an element, for example a lamp, can be positioned on the shell 10, without the risk of being hit by the chin guard 30 during its displacement between the withdrawal and protection positions.

GENERAL DEFINITIONS

The shell 10 can be substantially symmetrical with respect to a plane of symmetry.

A longitudinal direction at a given point of the helmet is defined by an intersection between a plane parallel to the plane of symmetry and the shell 10 at the given point.

The terms front and rear are used so that when the helmet is worn by an individual, a rear part of an element is closer to the back of the skull and the neck of the individual than a front part of the same element, the front part being closer to the face of the individual.

The terms inner and outer are used so that when the helmet is worn by an individual, an inner part of an element is closer to the head of an individual wearing the helmet than an outer part of the same element.

Shell

The shell 10 is adapted to receive the skull of the wearer. Particularly, the shell 10 can enclose the skull of the wearer from the top of the forehead of the wearer to the base of the back of their neck.

The shell 10 constitutes the general outer shape of the safety helmet, and can comply with standards (for example standard EN 397). The shell 10 may have a complex shape. The shape of the shell 10 can be adapted to make it possible to receive the skull of the wearer, while meeting mechanical constraints, for example shock resistance constraints, normative constraints and aesthetic constraints which impact the outer shape of the safety helmet.

The shell 10 can be integrally formed in one piece, or be made up of several inserts.

The shell 10 comprises a suitable front part located near the forehead of the wearer and a rear part located near the back of the neck of the wearer when the shell 10 is worn by an individual. The front part of the shell 10 can extend from the top of the forehead of the wearer to the vicinity of the top of the skull of the wearer. The rear part of the shell 10 can extend from the vicinity of the top of the skull of the wearer to the back of the neck of the wearer.

The front part of the shell 10 may have a front edge, delimiting the end of the shell 10 which is located near the forehead of the wearer.

The helmet can comprise an inner shell 60 adapted to be disposed oppositely to the shell 10, in a more inner position than the shell 10. The shell 10 can be fixed on the inner shell 60, for example by screwing.

The helmet can further comprise a harness 70 adapted to be disposed in contact with the skull of the wearer of the helmet between the head of the wearer and the shell 10, where appropriate between the head of the wearer and the inner shell 60. The harness 70 ensures comfort to the wearer of the helmet and absorbs shocks.

The shell 10, and/or where appropriate the inner shell 60, can be formed of a hard material with a smooth finish such as a thermoplastic material, of the ABS, PA, PP type, or any other possible material.

Shield

The shield 20 can have dimensions adapted to protect part of the face of the wearer including one or more areas among the forehead, the eyes, the nose and/or the mouth.

The shield 20 can be made of a material that does not obstruct the view of the wearer, for example a transparent, smoked or colored material. The material of the shield 20 can meet optical requirement criteria defined in a standard (standard EN 166 for example), and be a shock-resistant material in a temperature range also defined by a standard (standard EN 166 for example). By way of example, the shield 20 can be formed of a polymer material, such as polycarbonate.

The shield 20 can have a substantially curved shape. The shield 20 can have a substantially bubble shape, a spherical shape, a toroidal shape, an elliptical shape or any other shape that can be envisaged to ensure protection of part of the face of the wearer while ensuring a level of optical quality compliant with the standard (standard EN 16 for example).

The shield 20 can further comprise a shield support 21 secured to the shield 20 and forming a skeleton 21 at least partially surrounding the shield 20. The shield 20 can be put in position relative to the shield support 21 for example by clipping, bonding, interlocking, plastic screw or by any other possible means.

The shield 20 can act as an abutment for the chin guard 30 when the chin guard 30 is pressed against the shield 20. More particularly, the shield support 21 can act as an abutment for the chin guard 30 when the chin guard 30 is pressed against the shield 20 in the protection position.

The shield 20 can be adapted to be moved between a lowered position in which the shield 20 protects part of the face of the individual wearing the helmet, and a raised position in which the shield 20 is obscured so as to expose the face of the individual wearing the helmet. FIGS. 2 to 8 illustrate, by way of non-limiting examples, safety helmets comprising a shield 20, the shield 20 being in the lowered position.

In the lowered position, the shield 20 can be disposed oppositely to the face of the individual wearing the helmet, in front of the face of the wearer, in order to protect the face of the wearer of the helmet. In the raised position, the shield 20 can be disposed oppositely to the skull of the wearer of the helmet and the shell 10, where appropriate oppositely to the skull of the wearer of the helmet and the inner shell 60, so as to minimize a space requirement of the helmet.

In the raised position, the shield 20 can be disposed at the level of the shell 10, in a position adjacent to the shell 10. The shield 20 may have a curvature close to the curvature of the shell 10 and/or to the curvature of the inner shell 60 so as to minimize the space requirement of the safety helmet when the shield 20 is disposed oppositely to the shell 10 in the raised position.

In the raised position, the shield 20 can be obscured between the shell 10 and the head of the wearer of the helmet, the shield 20 being located in a more inner position than the shell 10. Where appropriate, the shield 20 can be obscured between the shell 10 and the inner shell 60. The shell 10 and the inner shell 60 can serve as a guide for a controlled displacement of the shield 20 between the shell 10 and the inner shell 60. As a variant, the shield 20 can be obscured in an outer position relative to the shell 10 of the helmet.

In the lowered position, the shield 20 can extend from the front edge of the front part of the shell 10. Thus, a continuity of the protection is ensured between the protection of the face offered by the shield 20 and the chin guard 30, and the protection of the skull offered by the shell 10.

The shield support 21 can integrate on its low part a form of a "beak" whose role is to increase the protection provided by the shield 20 at the level of the lower face of the wearer when the shield 20 is in the lowered position, and to serve as a visor for the wearer of the helmet when the shield 20 is in the raised position.

Chin Guard

The chin guard 30 can have dimensions adapted to protect part of the face of the wearer including one or more areas of the cheeks, the ears, the mouth and/or the chin. The chin guard 30 can further have dimensions adapted to protect part or all of the neck of the wearer of the helmet.

In the protection position, the chin guard 30 can be disposed oppositely to the face of the individual wearing the helmet, in front of the face of the wearer, in order to protect the face of the wearer of the helmet. In the withdrawal position, the chin guard 30 can be disposed oppositely to the skull of the wearer of the helmet and the shell 10, so as to minimize a space requirement of the helmet.

When the chin guard 30 is in the withdrawal position, the chin guard 30 can be obscured and disposed at the level of the shell 10, in a position adjacent to the shell 10, or even in contact with the shell 10. The shapes and dimensions of the chin guard 30, particularly a curvature of the chin guard 30, can be chosen so as to allow a shape cooperation between the chin guard 30 and the shell 10 so that when the chin guard 30 is disposed oppositely to the shell 10, the space requirement of the safety helmet is minimized.

When the chin guard 30 is in the protection position, the chin guard 30 can have dimensions adapted to ensure the protection of the entire part of the face of the wearer which is not protected by the shield 20 when the chin guard 30 is in the protection position. Thus, the entire face of the wearer is protected against potential external attacks and the consequences related to short-circuits.

When the chin guard 30 is in the protection position and the shield 20 is in the lowered position, the chin guard 30 can be located in a more outer position than the shield 20 relative to the face of the wearer of the helmet, the chin guard 30 being pressed against the shield 20 at the front of the shield 20.

The displacement of the chin guard 30 between the protection position and the withdrawal position can be independent of the displacement of the shield 20 between the lowered position and the raised position. More particularly, the system for articulating 50 the chin guard 30 relative to the shell 10 can be adapted to allow a controlled displacement of the chin guard 30 between the protection position and the withdrawal position independently of a displacement of the shield 20 between the lowered position and the raised position. This independence of the displacements allows the wearer of the helmet to adapt the size of the area of their face protected by the helmet according to the situation. For example, the wearer of the helmet can move the shield 20 from the raised position to the lowered position, so as to ensure the protection of an area of the face by the shield 20, the chin guard 30 remaining fixed, for example in the withdrawal position.

The chin guard 30 can be formed in a thermoplastic material, of the ABS, PA, PP type or any other possible material.

The chin guard 30 can be formed from a transparent material. A transparent chin guard 30 increases the visual field of the wearer of the helmet.

Articulation System

The articulation system 50 can comprise a casing 56 adapted to be added and fixed onto the shell 10. The casing 56 can have an inner surface adapted to be added and fixed onto an outer surface of the shell 10. The casing 56 has an outer surface opposite to the inner surface, and side surfaces adapted to connect the inner and outer surfaces of the casing 56. A casing space 56 is thus formed between the surfaces of the casing 56. The inner surface of the casing 56 can have shapes substantially complementary to the shapes of an area of the outer surface of the shell 10 at the level of which the casing 56 is intended to be added and fixed, so as to match the shapes of the shell 10.

The casing 56 can be fixed on the shell 10 by means of a clipping of the casing 56 on the shell 10. The casing 56 and the shell 10 can comprise respective clipping means adapted to allow a clipping of the casing 56 on the shell 10, for example by means of a clipping of a clipping tab of the casing 56 in a slot of the shell 10. Thus, the casing 56 can be unclipped from the shell 10, for example to change the casing 56, or to change or temporarily remove the chin guard 30.

The casing 56 and the chin guard 30 can comprise respective elements adapted to cooperate when the chin guard 30 is in the withdrawal position, so as to ensure that the chin guard 30 is maintained in the withdrawal position.

Figure 6:
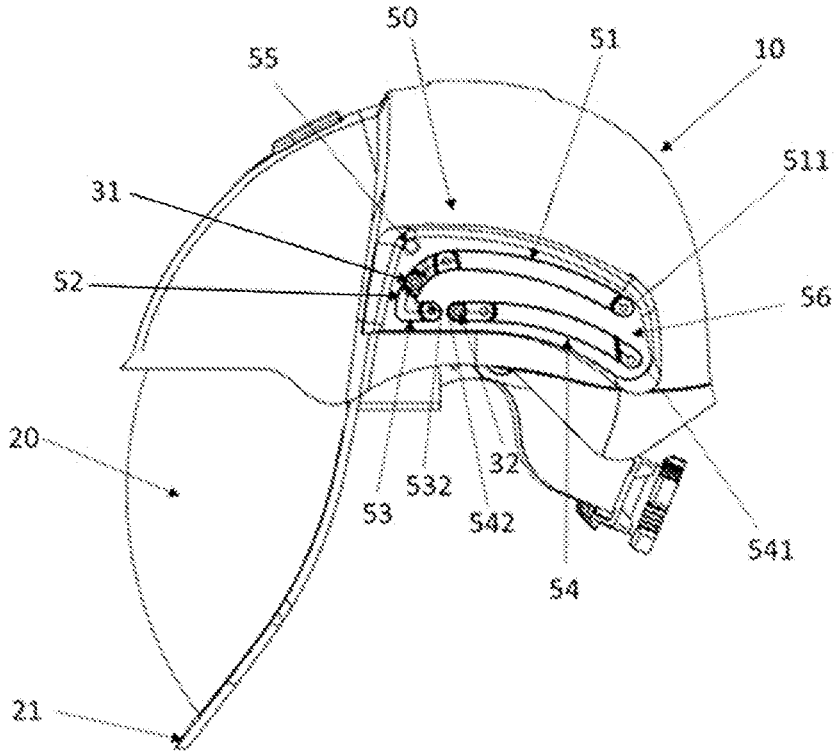
FIG. 6 represents a schematic side view of a safety helmet according to one embodiment of the invention, the chin guard apart from its guide pins being hidden to reveal the articulation system.

For example, as illustrated in FIG. 6, a recess 55 may be formed in the outer surface of the casing 56 and the chin guard 30 may comprise a protrusion of a shape complementary to the shape of the recess 55 of the casing 56. The protrusion of the chin guard 30 and the recess 55 of the casing 56 are positioned so that when the chin guard 30 is in the withdrawal position, the protrusion of the chin guard 30 is positioned in the recess 55 of the casing 56.

Thus, the chin guard 30 is unlikely to be moved from the withdrawal position, by the simple effect of gravity or of an external disturbance. On the other hand, the cooperation of the recess 55 of the casing 56 and of the protrusion of the chin guard 30 does not prevent a displacement of the chin guard 30 between the withdrawal position and the protection position during the application of a corresponding force by the operator, said force being adapted to make the protrusion of the chin guard 30 emerge from the recess 55 of the casing 56.

As a variant, the chin guard 30 can include a recess and the casing 56 can include a protrusion, the recess and the protrusion being adapted to cooperate so as to ensure that the chin guard 30 is maintained in the withdrawal position.

The helmet can comprise two articulation systems, disposed on respective sides of the shell 10, on either side of the plane of symmetry of the shell 10, substantially symmetrically with respect to the plane of symmetry. The two articulation systems can be substantially identical and symmetrical. Consequently, only one articulation system 50 will be described below. The articulation system 50 can be formed of a thermoplastic material, of the ABS, PA, PP type, or any other possible material.

Guide Means

The guide means of the articulation system 50 are adapted to guide the displacement of the chin guard 30 between the protection and withdrawal positions.

The guide means of the articulation system 50 can comprise one or more guide slot(s). The chin guard 30 comprises one or more guide pin(s) 31 adapted to slide inside the respective guide slot(s) so as to guide a controlled displacement of the chin guard 30 between the withdrawal and protection positions.

The guide slot can be a through slot formed in the casing 56 of the articulation system 50, particularly in the outer surface of the casing 56 of the articulation system 50. The guide slot can have a complex three-dimensional profile. The sliding of the guide pin 31 in the guide slot takes place along the three-dimensional profile of the guide slot.

The guide slot has a first end 511 and a second end 532 opposite to the first end 511. Between its first end 511 and its second end 532, that is to say along the guide slot, a direction and/or a curvature of the guide slot may vary.

The guide slot has a length corresponding to a curvilinear distance between the first end 511 and the second end 532 of the slot.

The slot has a thickness corresponding to a dimension of the slot, at a given point of the slot, in a direction perpendicular to a plane tangent to the outer surface of the casing 56. The thickness of the slot corresponds, when the slot is a through slot, to a thickness of the casing 56 of the articulation system 50, particularly to a thickness of the outer surface of the casing 56. The thickness of the slot can be substantially constant along the slot.

The slot has a width corresponding to a dimension of the slot, at a given point of the slot, in a direction substantially perpendicular both to the direction of the thickness and to the direction of the length of the slot at the given point of the slot. The width of the slot can be substantially constant along the slot.

The guide pin 31 can be formed in one piece with the chin guard 30, or be added and fixed onto the chin guard 30. The guide pin 31 can have contours approximating the shape of the guide slot. Particularly, the guide pin 31 can have a width substantially smaller than the width of the slot and a thickness substantially greater than the thickness of the slot. The guide pin 31 can have a substantially cylindrical shape. As a variant, the guide pin 31 can have any other shape adapted to slide in the guide slot, for example a T-shape. The guide pin 31 can for example be a screw or a nail.

The chin guard 30 can comprise a rotary ring disposed around the guide pin 31. The rotary ring can be substantially circular and disposed around guide pin 31 which is substantially cylindrical. A diameter of the rotary ring can substantially correspond to a width of the guide slot so that the rotary ring is in contact with the guide slot and rolls in the guide slot during the sliding of the guide pin 31 in the guide slot. The rotation of the ring in the guide slot is adapted to reduce the frictions so as to facilitate the sliding of the guide pin 31 in the slot.

The chin guard 30 can be put in position and articulated relative to the safety helmet by means of the articulation system 50. Particularly, the chin guard 30 can be put in position relative to the guide slot by means of its guide pin 31.

The guide slot can comprise:

- a first portion 51 adapted to guide a sliding of the chin guard 30 between the withdrawal position and a first intermediate position,
- a second portion 52 adapted to guide a switching of the chin guard 30 between the first intermediate position and a second intermediate position, in which in the second intermediate position, the chin guard 30 is positioned at least partially around the shield 20 and at a distance from the shield 20, and
- a third portion 53 adapted to guide a pressing of the chin guard 30 against the shield 20 between the second intermediate position and the protection position.

The first portion 51 of the guide slot can mainly extend in the longitudinal direction at the level of an area of the shell 10 on which the articulation system 50 is disposed.

The first end 511 of the guide slot corresponds to a rear end of the first portion 51 of the guide slot. The rear end 511 of the first portion 51 of the guide slot can be adapted to form an abutment for the guide pin 31 when the chin guard 30 is in the withdrawal position, so as to limit a rearward displacement of the chin guard 30.

The second portion 52 of the guide slot can be adapted to connect the first portion 51 and the third portion 53, and can have a curvature adapted to allow a switching of the chin guard 30 during the sliding of the guide pin 31 in the second slot portion 52. The second portion 52 of the guide slot can be located at least partially in a position further forward than the first portion 51 of the guide slot and the third portion 53 of the guide slot.

The third portion 53 of the guide slot can extend mainly in the longitudinal direction at the level of an area of the shell 10 on which the articulation system 50 is disposed. The third portion 53 of the guide slot can be disposed at a distance from the first portion 51 of the guide slot.

The second end 532 of the guide slot corresponds to a rear end of the third portion 53 of the guide slot. The rear end 532 of the third portion 53 of the guide slot can be adapted to form an abutment for the guide pin 31 when the chin guard 30 is in the protection position, so as to limit a rearward displacement of the chin guard 30. Alternatively or additionally, the chin guard 30 in the protection position can be in abutment against the shield 20.

The first portion 51 of the guide slot can have larger dimensions than the third portion 53 of the guide slot. Thus, an amplitude of the sliding movement of the chin guard 30 between the withdrawal position and the first intermediate position is greater than an amplitude of the pressing movement of the chin guard 30 against the shield 20 between the second intermediate position and the protection position.

The guide slot can have substantially the shape of a cane, the first portion 51 and the third portion 53 of the guide slot being disposed at a distance from each other and mainly extending in a longitudinal direction of the helmet, and the second portion 52 of the guide slot being curved and connecting the first portion 51 and the third portion 53 of the guide slot.

The sliding of the chin guard 30 from the withdrawal position to the first intermediate position can correspond to a displacement of the chin guard 30 from the rear part of the shell 10 to the front part of the shell 10. The guide pin 31 slides in the first slot portion 51, from its rear end 511 which corresponds to the first end of the guide slot and forward.

The sliding of the chin guard 30 from the first intermediate position to the withdrawal position can correspond substantially to the reverse displacement of the displacement of the chin guard 30 from the withdrawal position to the first intermediate position, the guide pin 31 being moved in the first slot portion 51 rearward until reaching the rear end 511 against which it abuts so as to limit a rearward displacement of the chin guard 30.

Figure 2:
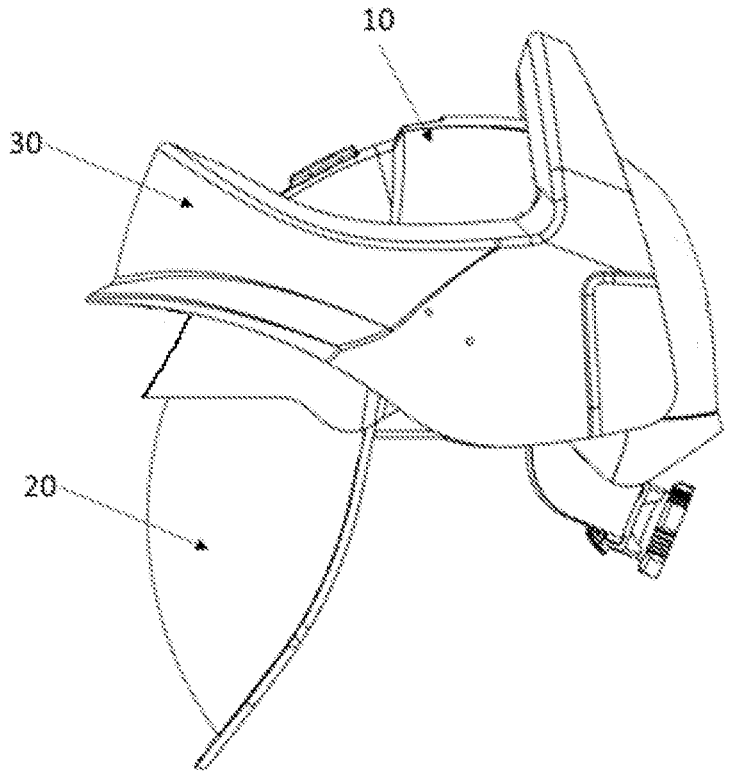
FIGS. 2 to 5 represent schematic side views of a safety helmet according to one embodiment of the invention, the chin guard being respectively in the withdrawal position, in a first intermediate position, in a position between the first intermediate position and the second intermediate position, and in the protection position.
Figure 3:
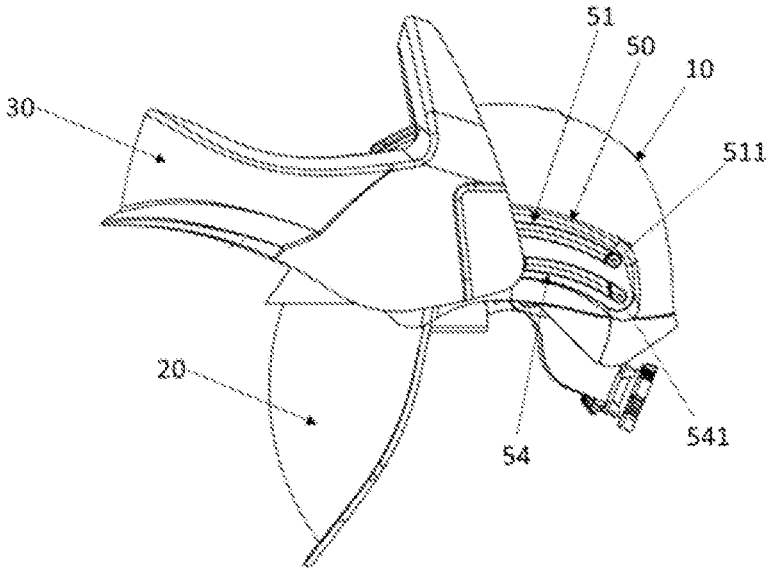

In the first intermediate position, the chin guard 30 is thus located in a position further forward than in the withdrawal position. FIG. 2 illustrates, by way of non-limiting example, a helmet comprising a chin guard 30 in the withdrawal position. FIG. 3 illustrates by way of non-limiting example a helmet comprising a chin guard 30 in the first intermediate position.

In the first intermediate position, the chin guard 30 can be disposed oppositely to the shell 10, in an outer position relative to the shell 10 and near the shell 10, so as to minimize a space requirement of the helmet. The sliding of the chin guard 30 between the withdrawal position and the first intermediate position can correspond substantially to a translation without modification of an orientation of the chin guard 30, so that the chin guard 30 remains disposed oppositely to the shell 10 during its sliding between the withdrawal position and the first intermediate position. During said sliding of the chin guard 30 between the withdrawal position and the first intermediate position, the pressing means 90 may not press the chin guard 30 against the helmet. Thus, the chin guard 30 is disposed at a distance from the shell 10 sufficient to allow the displacement of the chin guard 30 without hitting any elements disposed on the top of the shell 10, while being at a sufficiently short distance from the shell 10 to reduce a space requirement of the helmet.

The chin guard 30 can be moved between the withdrawal position and the first intermediate position by means of a force exerted on the chin guard 30 by the wearer of the helmet, rearward for a displacement towards the withdrawal position and forward for a displacement towards the first intermediate position.

In the second intermediate position, the chin guard 30 can be disposed substantially oppositely to the face of the individual wearing the helmet, in front of the face of the wearer, at a distance from the face greater than that of the chin guard 30 in the protection position. The switching of the chin guard 30 from the first intermediate position to the second intermediate position therefore comprises a switching of the chin guard 30 from an orientation oppositely to the shell 10 to an orientation oppositely to the face of the wearer, and vice versa.

During the displacement of the chin guard 30 between the first intermediate position and the second intermediate position, the guide pin 31 slides in the second slot portion 52.

The chin guard 30 can further comprise an abutment pin adapted to abut against the articulation system 50, particularly against the casing 56 of the articulation system 50, so as to limit a switching of the chin guard 30 during the displacement of the chin guard between the withdrawal position and the protection position.

The abutment pin can in particular prevent the chin guard 30 from switching beyond the orientation oppositely to the shell 10 during its displacement from the second intermediate position to the first intermediate position. The casing 56 of the articulation system 50 then forms an abutment for the abutment pin of the chin guard 30 when the chin guard 30 reaches the first intermediate position. Thus, the chin guard 30 is maintained near the shell 10, oppositely to the shell 10, during its displacement between the first intermediate position and the withdrawal position, which makes it possible to limit the space requirement of the helmet.

Figure 4:
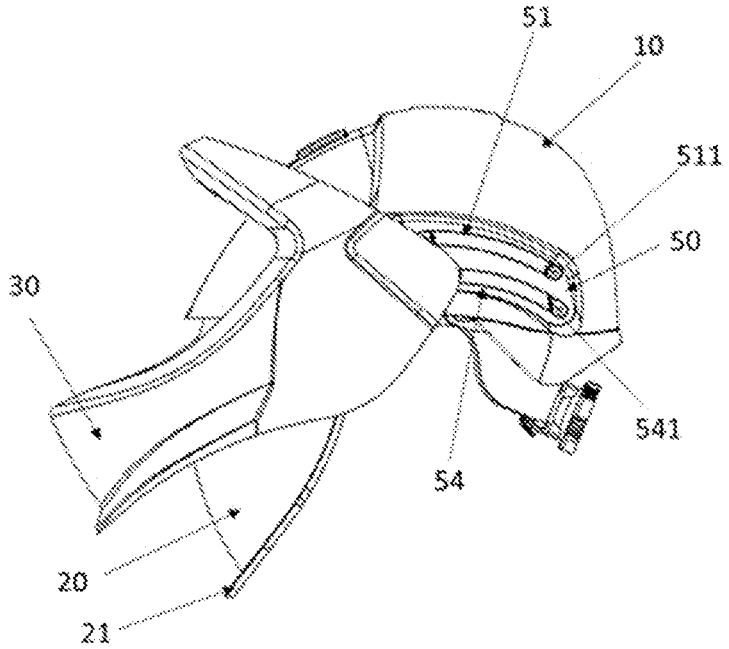

FIG. 4 illustrates by way of non-limiting example a helmet comprising a chin guard 30 in a position between the first intermediate position and the second intermediate position. FIG. 6 illustrates by way of non-limiting example a helmet comprising a chin guard 30 (not represented except for its guide pins 31, 32) in a position between the first intermediate position and the second intermediate position.

The chin guard 30 can be moved between the first intermediate position and the second intermediate position by means of a force exerted on the chin guard 30 by the wearer of the helmet. The pressing of the chin guard 30 from the second intermediate position to the protection position can correspond to a displacement of the chin guard 30 from the front to the back, tending to bring the chin guard 30 closer to the face of the wearer and adapted to press the chin guard 30 against the protective shield 20. The guide pin 31 slides in the third slot portion 53, from the front and towards its rear end 532 which corresponds to the second end of the guide slot.

The sliding of the chin guard 30 from the protection position to the second intermediate position can substantially correspond to the reverse displacement of the displacement of the chin guard 30 from the second intermediate position to the protection position, the guide pin 31 being moved in the third slot portion 53 forward from the rear end 532 of the third slot portion 53.

Figure 5:
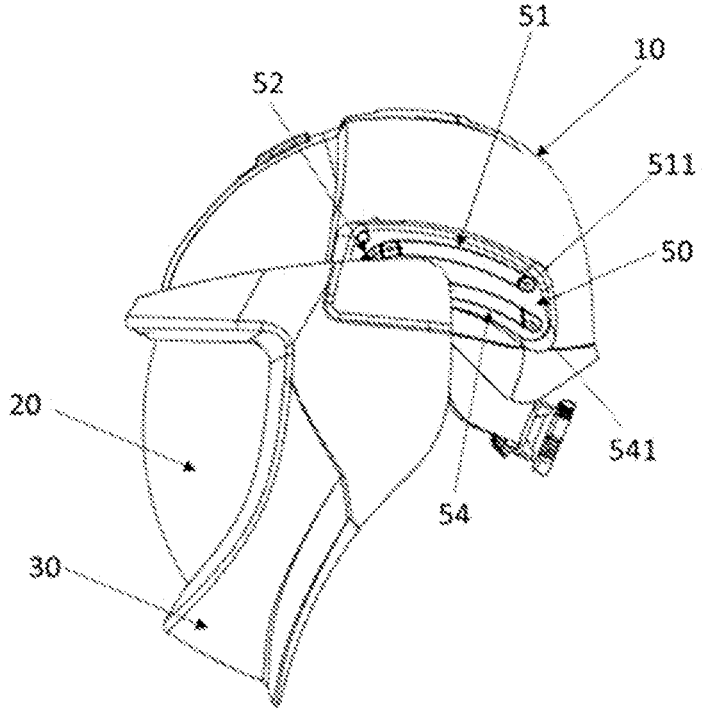

In the second intermediate position, the chin guard 30 is thus located in a position further forward than in the protection position. FIG. 5 illustrates, by way of non-limiting example, a helmet comprising a chin guard 30 in the protection position.

The pressing of the chin guard 30 between the second intermediate position and the protection position can substantially correspond to a translation without modification of an orientation of the chin guard 30, so that the chin guard 30 is disposed during said pressing at the front of and oppositely to the face of the wearer of the helmet.

The articulation system 50 can comprise an additional guide slot 54 having dimensions substantially similar to the dimensions of the first portion 51 of the guide slot. The additional guide slot 54 mainly extends in a longitudinal direction of the helmet.

The additional guide slot 54 can be disposed substantially in an extension of the third portion 53 of the guide slot at a distance from the third portion 53 of the guide slot, the guide slot and the additional guide slot 54 not being connected.

The chin guard 30 comprises an additional guide pin 32 adapted to slide inside the additional guide slot 54 when the chin guard 30 is moved between the withdrawal and protection positions.

Thus, during the displacement of the chin guard 30 between the withdrawal and protection positions, the guide pin 31 slides in the guide slot and the additional guide pin 32 slides in the additional guide slot 54.

The guiding of the displacement of the chin guard 30 is thereby improved. Particularly, the joint guiding of the guide pin 31 in the guide slot and of the additional guide pin 32 in the additional guide slot 54 makes it possible to control an orientation of the chin guard 30.

The additional guide slot 54 comprises a rear end 541 and a front end 542 longitudinally opposite to the rear end 541. The rear end 541 of the additional guide slot 54 can be adapted to form an abutment for the additional guide pin 32 when the chin guard 30 is in the withdrawal position, so as to limit a rearward displacement of the chin guard 30. Thus, in the withdrawal position, the guide pin 31 is in abutment against the rear end 511 of the guide slot, and the additional guide pin 32 is in abutment against the rear end 541 of the additional guide slot 54.

During the displacement of the chin guard 30 between the withdrawal position and the first intermediate position, the guide pin 31 slides in the first slot portion 51 and the additional guide pin 32 slides in the additional guide slot 54, which ensures a constant and controlled orientation of the chin guard 30, the chin guard 30 being disposed oppositely to the shell 10 so as to minimize a space requirement of the helmet.

Similarly, during the displacement of the chin guard 30 between the second intermediate position and the protection position, the guide pin 31 slides in the third slot portion 53 and the additional guide pin 32 slides in the additional guide slot 54, which makes it possible to ensure a constant and controlled orientation of the chin guard 30, the chin guard 30 being disposed oppositely to the shell 10 so as to minimize a space requirement of the helmet.

The front end 542 of the additional guide slot can be adapted to form an abutment for the additional guide pin 32 during the switching of the chin guard 30 between the first intermediate position and the second intermediate position, the switching of the chin guard 30 taking place around the additional guide pin 32.

During the switching of the chin guard 30 between the first intermediate position and the second intermediate position, the guide pin 31 slides in the second slot portion 52 and the additional guide pin 32 is in abutment against the front end 542 of the additional guide slot 54. Thus, the sliding of the guide pin 31 in the second slot portion 52 makes it possible to modify the orientation of the chin guard 30 in a way controlled by the shape of the second slot, which allows the chin guard 30 to be opposite the face of the wearer in the second intermediate position or opposite the shell 10 in the first intermediate position.

Figure 10:
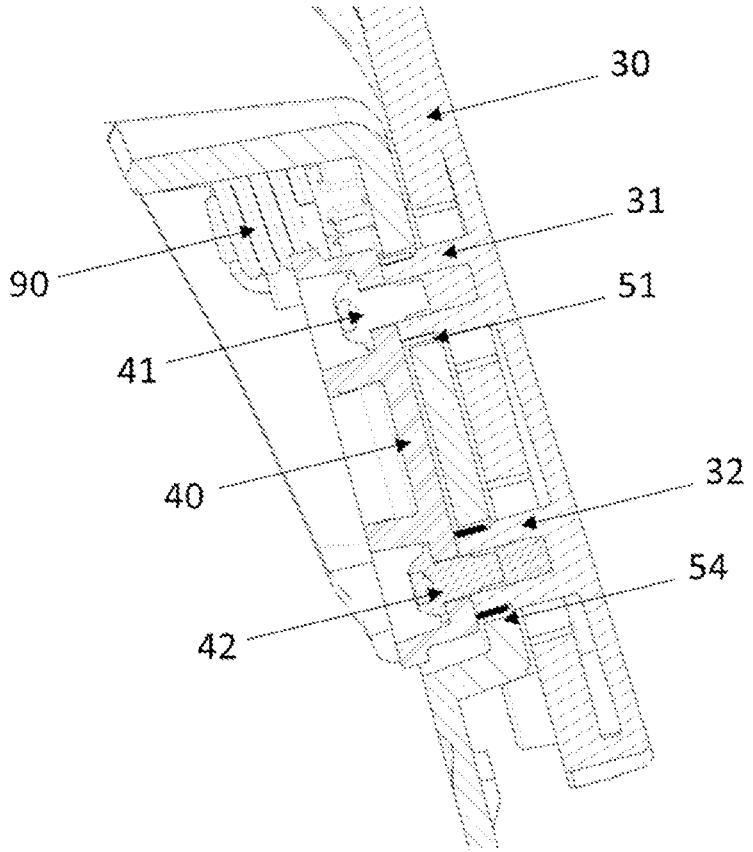
FIG. 10 represents a perspective sectional view of the articulation system and of the chin guard pins according to FIGS. 9*a* and 9*b*.

The guide means can further comprise a connecting rod 40 adapted to be added and fixed onto the guide pin 31 and onto the additional guide pin 32. The connecting rod 40 can act as an abutment preventing the pins 31, 32 from emerging from the slots 51, 52, 53, 54, and/or as means for biasing the pressing means. FIG. 10 illustrates, by way of non-limiting example, a connecting rod 40 thus added and fixed onto the chin guard 30.

The connecting rod 40 is adapted to improve the guiding of the controlled displacement of the guide pin 31 and of the additional guide pin 32, particularly during a switching of the chin guard 30 between the first intermediate position and the second intermediate position around the additional guide pin 32.

The connecting rod 40 can comprise two orifices adapted to respectively receive a connecting rod pin 41 and an additional connecting rod pin 42. The connecting rod 40 can be placed and fixed on the chin guard 30 by means of a fixing of the connecting rod pins 41, 42 and of the chin guard pins 31, 32.

More particularly, the connecting rod pin 41 can be adapted to be fixed in a removable manner on the guide pin 31 of the chin guard 30 and the additional connecting rod pin 42 can be adapted to be fixed in a removable manner on the additional guiding pin 32 of the chin guard 30. The connecting rod pins 41, 42, can be screws adapted to be screwed into the respective chin guard pins 31, 32.

During the switching of the chin guard 30 between the first intermediate position and the second intermediate position, the additional guide pin 32 is in abutment against the front end 542 of the additional guide slot 54, while the guide pin 31 slides in the second portion 52 of the guide slot. The distance between the chin guard pins 31, 32, the distance between the guide slots 52, 54, as well as the shape of the slots 52, 54, makes it possible to control the orientation of the connecting rod 40 during the switching of the chin guard 30, and thus makes it possible to control the path of the chin guard 30 in space. The chin guard 30 can therefore switch between an orientation oppositely to the face of the wearer of the helmet and an orientation oppositely to the skull of the wearer of the helmet.

Figure 11A:
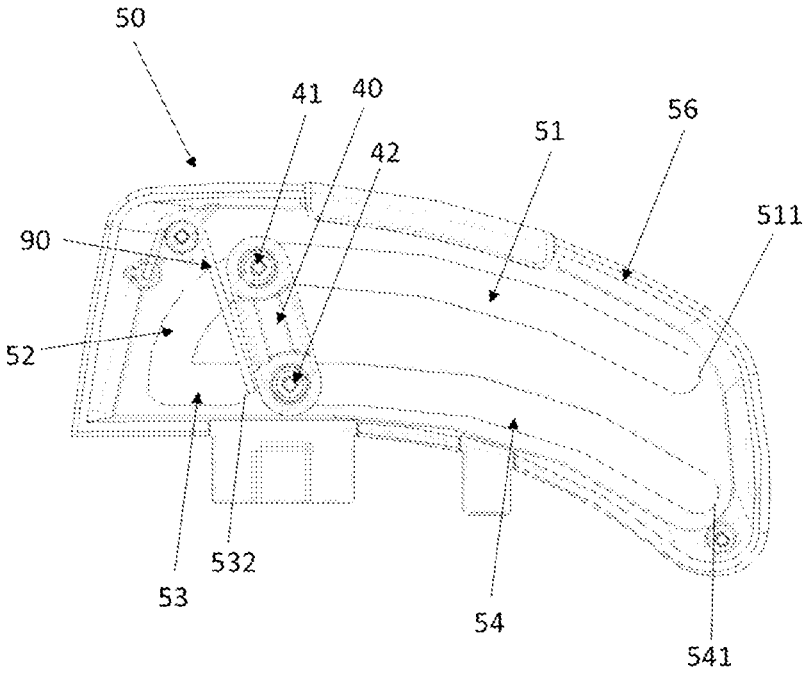
FIGS. 11*a*, 11*b*, 11*c* and 11*d* represent schematic sectional side views of an articulation system according to one embodiment of the invention, for a chin guard respectively in the first intermediate position, in a position between the first intermediate position and the second intermediate position, in the second intermediate position, and in the withdrawal position.
Figure 11B:
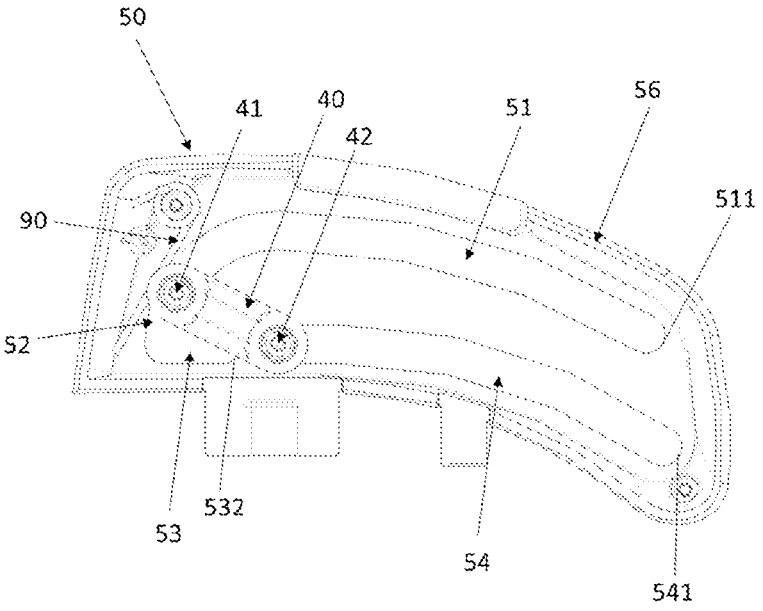
Figure 11C:
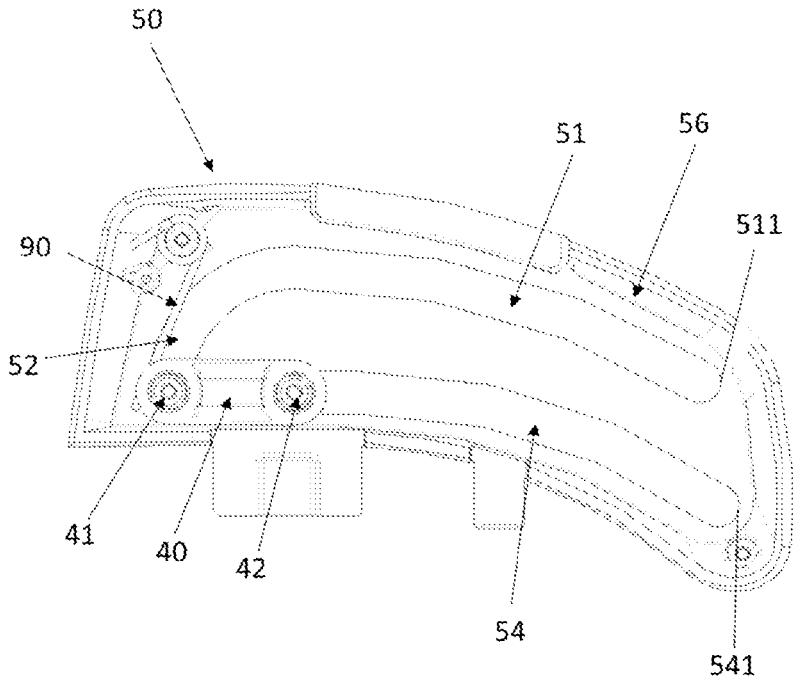

FIGS. 11*a* to 11*c* illustrate by way of non-limiting example the displacement of the connecting rod 40 and of the chin guard pins 31, 32, during the switching of the chin guard 30 between the first intermediate position and the second intermediate position.

Pressing Means

In a first embodiment, the pressing means 90 comprise elastic pressing means adapted to exert a restoring force tending to press the chin guard 30 against the shield 20. By elastic pressing, it is meant that the restoring force may vary with a position of the chin guard 30, the restoring force being able to increase when the chin guard 30 is moved away from the protection position.

The means for elastically pressing the chin guard 30 against the shield 20 make it possible to press the chin guard 30 against the shield 20, including in the case where the wearer of the helmet has not moved the chin guard 30 entirely to the protection position. Thus, the protection offered by the helmet is improved.

The pressing means can be configured so as to exert a restoring force on the chin guard 30 when the chin guard 30 is disposed near the protection position. Thus, the pressing means tend to return the chin guard 30 towards the protection position, which secures the positioning of the chin guard 30 in the protection position by limiting the risk of displacement of the chin guard 30 when it is in the protection position, without requiring any action from the wearer of the helmet.

The elastic pressing means 90 can be adapted so as not to be biased during the displacement of the chin guard 30 between the withdrawal position and the first intermediate position. Thus, the pressing means 90 do not exert a restoring force on the chin guard 30 when the chin guard 30 is between the withdrawal position and the first intermediate position. A space is then formed between the chin guard 30 and the shell 10.

Figure 7:
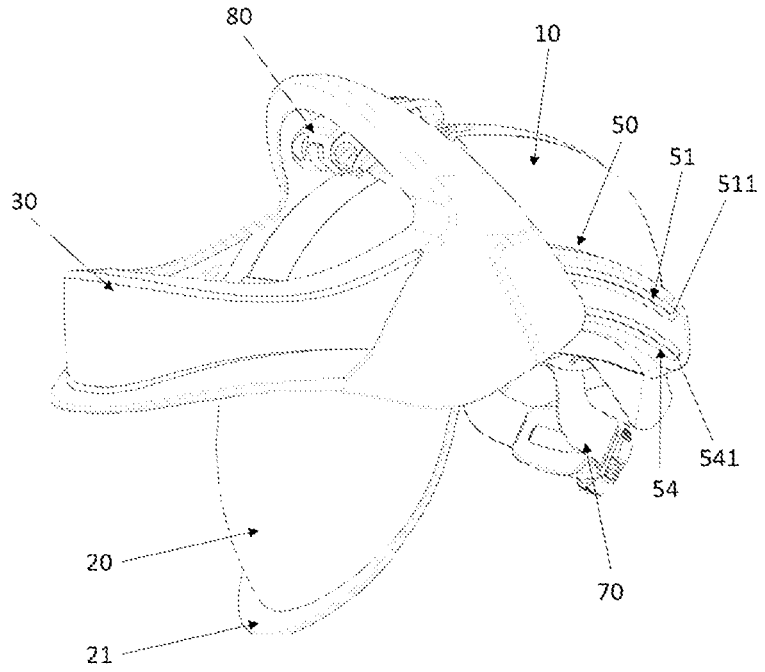
FIGS. 7 and 8 represent schematic perspective views of a safety helmet according to one embodiment of the invention, during a displacement of the chin guard in the absence of pressing of the chin guard.
Figure 8:
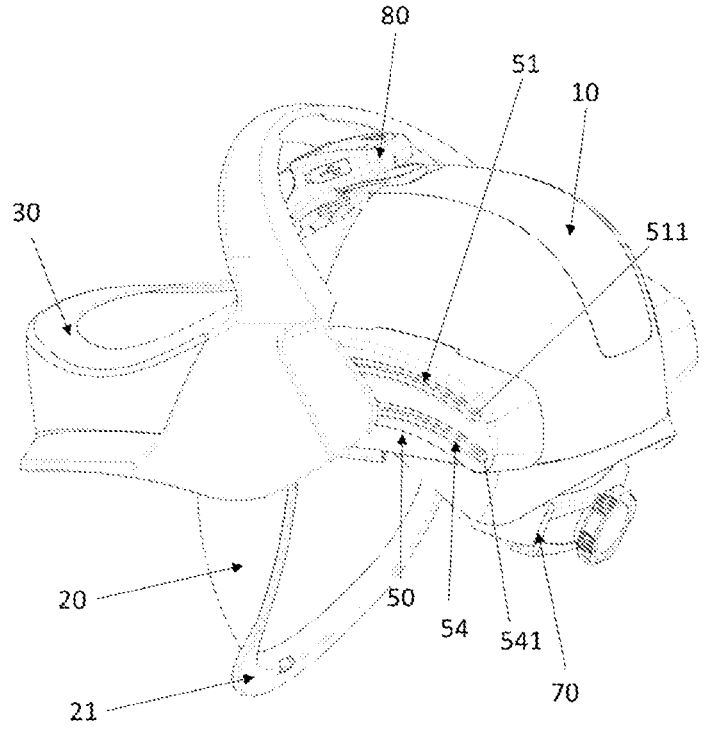
Figure 9A:
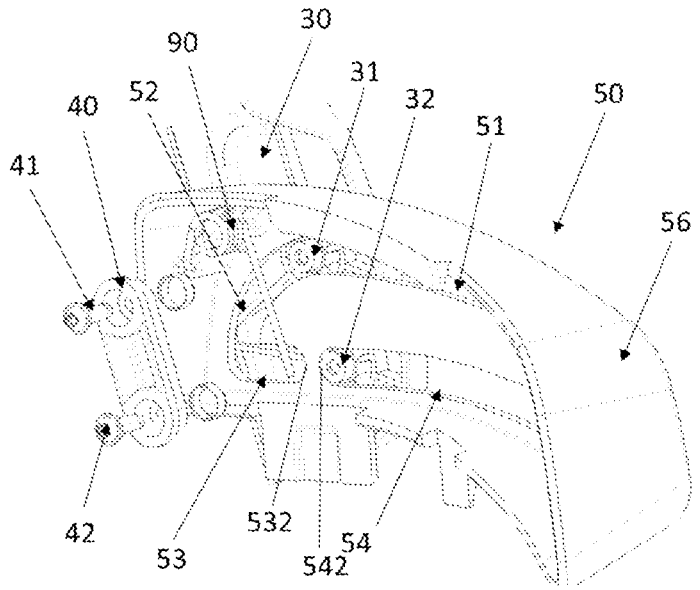
FIGS. 9*a* and 9*b* represent respectively an exploded perspective view and a perspective view, of an articulation system according to one embodiment of the invention, as well as chin guard pins of a chin guard in the first intermediate position.
Figure 9B:
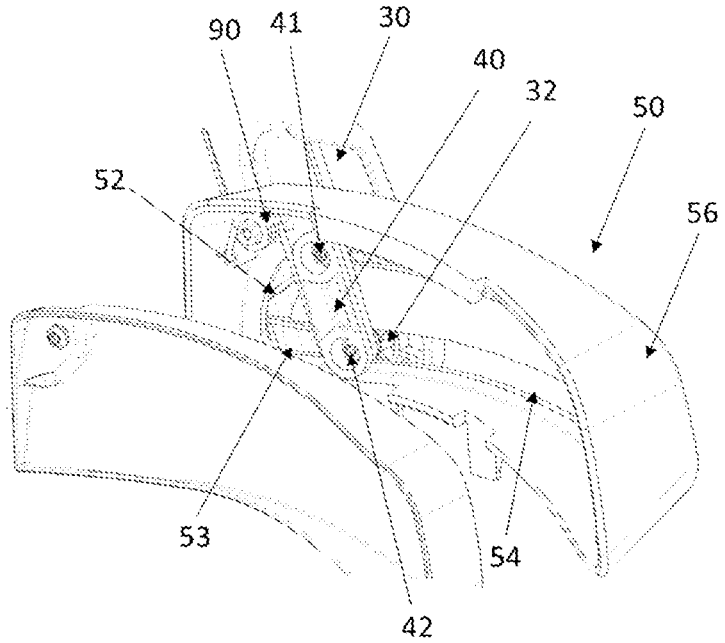

Thus, one or more element(s), for example a lamp, can be positioned on the shell 10, in a more outer position than the shell 10, without risking being hit by the chin guard 30 during its displacement between the withdrawal position and the first intermediate position, as illustrated by way of non-limiting example in FIGS. 7 and 8. The chin guard 30 is disposed at a distance from the shell 10 sufficient to allow the displacement of the chin guard 30 without hitting the possible element(s) disposed on the shell 10, while being at a sufficiently small distance from the shell 10 to reduce a space requirement of the helmet.

The elastic pressing means 90 can be adapted to be biased when the chin guard 30 is between the first intermediate position and the second intermediate position. FIGS. 11*a* to 11*c* illustrate, by way of non-limiting example, the biasing of the elastic pressing means 90 during the displacement of the chin guard 30 between the first intermediate position and the second intermediate position.

Particularly, the connecting rod 40 can be adapted to bias the pressing means 90 during a displacement of the chin guard 30 between the first intermediate position and the second intermediate position.

During the switching of the chin guard 30 between the first intermediate position and the second intermediate position, the pressing means 90 then exert a restoring force on the chin guard 30. The guide means oppose the pressing of the chin guard 30. Particularly, the second part of the guide slot 52 can form an abutment preventing a rearward displacement of the guide pin 31. Thus, during the switching between the first intermediate position and the second intermediate position, the chin guard 30 is not pressed by the action of the pressing means 90. A space is therefore formed between the chin guard 30 and the shell 10, so as to allow the switching of the chin guard 30 without hitting a possible element placed on the shell 10, in an outer position relative to the shell 10.

Figure 11D:
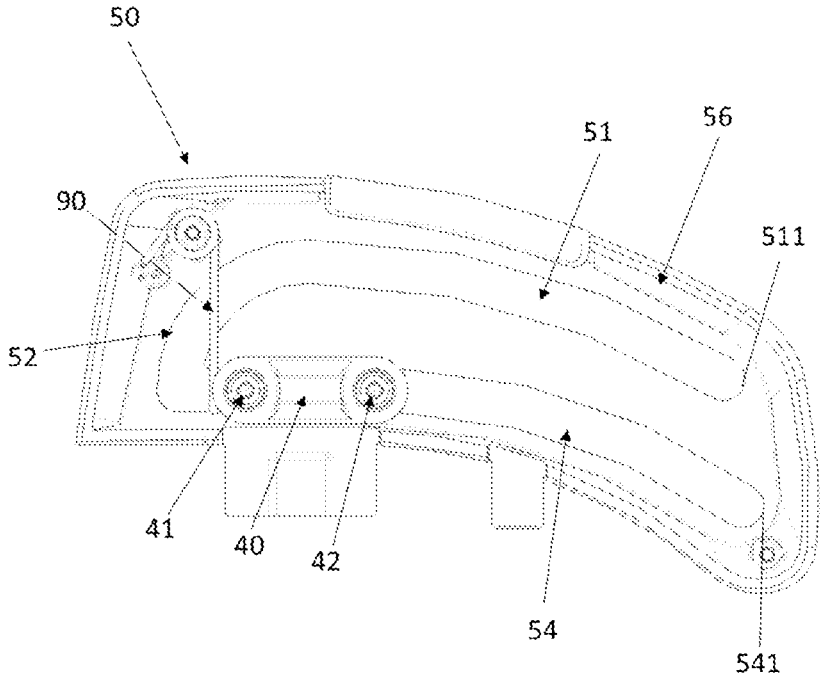

The elastic pressing means 90 can be adapted to exert a restoring force on the chin guard 30 when the chin guard 30 is between the second intermediate position and the protection position, the restoring force being adapted to press the chin guard 30 against the shield 20. FIGS. 11*c* and 11*d* illustrate, by way of non-limiting example, pressing means 90 exerting a restoring force on the chin guard 30 between the second intermediate position and the protection position. The restoring force is adapted to move the chin guard 30 rearward, towards the face of the wearer, from the second intermediate position to the protection position. The guide slot and, where appropriate, the additional guide slot 54 allow and guide the pressing of the chin guard 30 against the protective shield 20 from the second intermediate position to the protection position.

The chin guard 30 can thus be moved from the second intermediate position to the protection position by means of the restoring force exerted by the pressing means 90, without requiring any action on the part of the wearer of the helmet. The chin guard 30 can be moved from the protection position to the second intermediate position by means of a force exerted on the chin guard 30 by the wearer of the helmet, the force exerted by the wearer being sufficient to counter the restoring force exerted by the pressing means, and directed substantially forward.

In the protection position, the pressing means 90 can be at rest, that is to say not exert any restoring force on the chin guard 30. As a variant, in the protection position, the pressing means 90 can be biased so as to exert a restoring force on the chin guard 30 tending to press the chin guard 30 against the shield 20. The restoring force can thus be zero or non-zero when the chin guard 30 is in the protection position.

The restoring force exerted by the pressing means 90 can increase, when the chin guard 30 is between the protection position and the second intermediate position, when a distance between the chin guard 30 and the shield 20 increases. The restoring force can particularly be higher when the chin guard 30 is in the second intermediate position than when the chin guard 30 is in the protection position.

The pressing means 90 of the articulation system 50 can comprise a spring adapted to exert on the chin guard 30 a restoring force tending to press the chin guard 30 against the shield 20 when the chin guard 30 is near or in the protection position. For example, the spring 90 can exert on the chin guard 30 the restoring force when the chin guard 30 is between the first intermediate position and the protection position.

The guide means and the pressing means 90 can be arranged so that, during the displacement of the chin guard 30 between the first intermediate position and the second intermediate position, the displacement of the connecting rod 40 causes a displacement of the spring 90 adapted to bias the spring 90. The connecting rod 40 therefore acts on the spring 90 to bias it that is to say to move it relative to its rest position.

The spring 90 can be made of metal, which allows the spring 90 to accept significant deformations. As a variant, the spring 90 can be made of plastic material, or of metal coated with an insulating material, which allows the spring 90 to comply with some safety standards, particularly safety standards requiring the absence of metal parts in the safety helmet.

In a second embodiment, which is compatible with the first embodiment, the pressing means 90 comprise means for clipping the chin guard 30 against the shield 20. The clipping means can be disposed both on the chin guard 30 and on the shield 20, and make it possible to secure the positioning of the chin guard 30 in the protection position. The clipping means can be implemented as an alternative or in addition to the elastic pressing means.

Kinematics of the Displacement of the Chin Guard Between the Withdrawal Position and the Protection Position The chin guard 30 can be moved from the withdrawal position to the protection position by carrying out the following three steps in order:

- sliding of the chin guard 30 from the withdrawal position to the first intermediate position;
- switching of the chin guard 30 from the first intermediate position to the second intermediate position;
- pressing of the chin guard 30 from the second intermediate position to the protection position, by means of the pressing means 90.

The pressing of the chin guard 30 can comprise a pressing of the chin guard 30 from the second intermediate position to the protection position, by means of a restoring force exerted by elastic pressing means 90, such as a spring.

Alternatively or in addition, the pressing of the chin guard 30 comprises a clipping of the chin guard 30 against the shield, by means of clipping means.

The chin guard 30 can be moved from the protection position to the withdrawal position by carrying out the following three steps in order:

moving the chin guard 30 from the protection position to the second intermediate position, by the application of a force opposing a force exerted by the pressing means 90, particularly by elastic pressing means 90;

switching of the chin guard 30 from the second intermediate position to the first intermediate position;

sliding of the chin guard 30 from the first intermediate position to the withdrawal position.

The displacement of the chin guard 30 from the protection position to the withdrawal position substantially corresponds to the reverse displacement of the displacement of the chin guard 30 from the withdrawal position to the protection position, the displacement being guided by the guide means of the articulation system 50.

Other embodiments can be envisaged and those skilled in the art can easily modify the embodiments or exemplary embodiments set out above or envisage others while remaining within the scope of the invention.

The invention claimed is:

1. A safety helmet adapted to be worn by an individual, comprising:

a shell configured to receive a skull of the individual;

a shield adapted to protect an area of the face of the individual;

a chin guard adapted to be moved between a withdrawal position and a protection position, wherein when worn and in the protection position, the chin guard is configured to be at least partially disposed around the shield so as to extend an area of protection of the face of the individual by the helmet;

an articulation system for articulating the chin guard relative to the shell, comprising means for guiding a displacement of the chin guard between the withdrawal position and the protection position, wherein the articulation system further comprises pressing means adapted to press the chin guard against the shield when the chin guard is proximate and in the protection position;

wherein the means for guiding the articulation system comprise a guide slot and wherein the chin guard comprises a guide pin adapted to slide inside the guide slot to guide a controlled displacement of the chin guard between the withdrawal and protection positions;

wherein the guide slot comprises:

a first portion adapted to guide a sliding of the chin guard between the withdrawal position and a first intermediate position, a second portion adapted to guide a switching of the chin guard between the first intermediate position and a second intermediate position, wherein in the second intermediate position, the chin guard is at least partially positioned around the shield and at a distance from the shield, and a third portion adapted to guide a pressing of the chin guard against the shield between the second intermediate position and the protection position; and wherein the articulation system comprises an additional guide slot having dimensions similar to dimensions of the first portion of the guide slot, the additional guide slot extending substantially in a longitudinal direction of the helmet and being aligned with the third portion of the guide slot at a distance from the third portion of the guide slot, and wherein the chin guard comprises an additional guide pin adapted to slide inside the additional guide slot when the chin guard is moved between the withdrawal and protection positions.

2. The safety helmet according to claim 1, wherein the pressing means of the articulation system comprise a spring adapted to exert on the chin guard a restoring force tending to press the chin guard against the shield when the chin guard is proximate or in the protection position.

3. The safety helmet according to claim 1, wherein the guide slot has substantially a shape of a cane, the first portion and the third portion of the guide slot being disposed at a distance from each other and extending substantially in a longitudinal direction of the helmet, and the second portion of the guide slot being curved and connecting the first portion and the third portion of the guide slot.

4. The safety helmet according to claim 1, wherein:

the first portion of the guide slot comprises a rear end adapted to form an abutment for the guide pin when the chin guard is in the withdrawal position, and the third portion of the guide slot comprises a rear end adapted to form an abutment for the guide pin when the chin guard is in the protection position, and wherein the additional guide slot comprises a rear end adapted to form an abutment for the additional guide pin when the chin guard is in the withdrawal position, and a front end adapted to form an abutment for the additional guide pin during switching of the chin guard between the first intermediate position and the second intermediate position, the switching of the chin guard taking place around the additional guide pin.

5. The safety helmet according to claim 1, wherein the means for guiding the articulation system further comprise a connecting rod adapted to be added and fixed onto the guide pin and onto the additional guide pin, wherein the connecting rod is adapted to bias the pressing means during a displacement of the chin guard between the first intermediate position and the second intermediate position.

6. The safety helmet according to claim 1, wherein the shield is adapted to be moved between a lowered position in which the shield protects part of the face of the individual wearing the helmet, and a raised position in which the shield is obscured to expose the face of the individual wearing the helmet.

7. The safety helmet according to claim 6, wherein the articulation system for articulating the chin guard relative to the shell is adapted to allow a controlled displacement of the chin guard between the protection position and the withdrawal position independently of a displacement of the shield between the lowered position and the raised position.

* * * * *